US010713892B2

(12) United States Patent
Walters, Jr. et al.

(10) Patent No.: US 10,713,892 B2
(45) Date of Patent: Jul. 14, 2020

(54) TOKEN DISPENSER SYSTEM, INSTALLATION APPARATUS, AND METHOD

(71) Applicant: NAMCO USA INC., Wood Dale, IL (US)

(72) Inventors: Kenneth William Walters, Jr., Kirkland, IL (US); John E. Vaughn, Palatine, IL (US); Timothy Craig Morrison, Carpentersville, IL (US)

(73) Assignee: NAMCO USA INC., Wood Dale, IL (US)

( * ) Notice: Subject to any disclaimer, the term of this patent is extended or adjusted under 35 U.S.C. 154(b) by 0 days.

(21) Appl. No.: 15/929,105

(22) Filed: Feb. 19, 2019

(65) Prior Publication Data

US 2019/0180562 A1 Jun. 13, 2019

Related U.S. Application Data

(63) Continuation of application No. 15/090,067, filed on Apr. 4, 2016, now Pat. No. 10,223,867, which is a continuation of application No. 13/836,550, filed on Mar. 15, 2013, now Pat. No. 9,330,528.

(51) Int. Cl.
*G07F 17/32* (2006.01)

(52) U.S. Cl.
CPC ..... *G07F 17/3248* (2013.01); *G07F 17/3216* (2013.01); *G07F 17/3246* (2013.01); *G07F 17/3251* (2013.01); *Y10T 29/49826* (2015.01)

(58) Field of Classification Search
CPC ..... G07F 17/3248; G07F 17/3216; G07F 17/3246; G07F 17/3251; Y10T 29/49826
USPC ..... 463/25
See application file for complete search history.

(56) References Cited

U.S. PATENT DOCUMENTS

| | | | |
|---|---|---|---|
| 4,541,547 | A | 9/1985 | Miknyocki et al. |
| 4,948,138 | A | 8/1990 | Pease et al. |
| 6,293,867 | B1 | 9/2001 | Heidel et al. |
| 6,705,475 | B2 | 3/2004 | Geiger |
| 9,330,528 | B2 | 5/2016 | Walters, Jr. et al. |

(Continued)

OTHER PUBLICATIONS

Global Coin-Op Equipment, GCE Universal Hopper Kit Advertisement.

(Continued)

*Primary Examiner* — David L Lewis
*Assistant Examiner* — Shauna-Kay Hall
(74) *Attorney, Agent, or Firm* — Marshall, Gerstein & Borun LLP; Randall G. Rueth

(57) ABSTRACT

A token dispensing system is adapted suitable for installing a token dispenser in a game device. A mounting bracket for the token dispenser provides a simple and inexpensive way to install the token dispenser as part of the token dispensing system inside the housing of a game device. The dispensing system includes an electronic control circuit that controls an alarm device to provide a low level warning signal when the level of tokens in the token dispenser is low and an empty warning signal when the token dispenser is empty. The electronic control circuit controls dispensing tokens from the token dispenser such that a user receives the correct number of tokens even if the dispenser runs out of tokens in the middle of dispensing a selected number of tokens during a transaction.

21 Claims, 5 Drawing Sheets

(56) References Cited

U.S. PATENT DOCUMENTS

| | | | | |
|---|---|---|---|---|
| 2003/0064674 | A1* | 4/2003 | Parham | G07F 17/32 453/63 |
| 2004/0224624 | A1* | 11/2004 | Terazawa | G07D 1/04 453/2 |
| 2004/0224626 | A1 | 11/2004 | Koch et al. | |

OTHER PUBLICATIONS

Vending Times, "Global Coin-Op Develops Solution for Quick-Coin Games in Cashless Venues", Oct. 2009.

* cited by examiner

TOKEN DISPENSER SYSTEM, INSTALLATION APPARATUS, AND METHOD

CROSS-REFERENCE TO RELATED APPLICATION

This is a Continuation of U.S. application Ser. No. 15/090,067, filed on Apr. 4, 2016, which is a Continuation of U.S. application Ser. No. 13/836,550, filed on Mar. 15, 2013. The entire contents of these applications are expressly incorporated herein by reference.

FIELD OF THE DISCLOSURE

The present disclosure relates to a token dispenser for dispensing tokens or coins, such as for use in a coin or token operated game device, and installation apparatus therefor.

BACKGROUND

An arcade is an area, such as a room, store, or building, with several arcade games arranged for play by users. Arcade games are game devices that generally operate on a pay to play basis, wherein a user must provide some form of monetary payment to the machine in order to play a game associated with the machine. Such game devices include, for example, mechanical games wherein the operator physically manipulates a mechanical mechanism in order to play the game, electromechanical games, which include both mechanical and electrical components manipulated by the user during play of the game, and electrical games, such as video games and other substantially purely electrical games. In all of these types of games, some sort of monetary payment must be received by the game device before the user can play the game. In the past, it was common to include an electrical or electromechanically operated coin receiver and switch to activate a game, wherein a user would insert a monetary coin, such as a quarter, into a coin slot to activate the game. In some mechanical games, the game itself is played with a token such as a circular coin or circular metal disk. Therefore, it was generally necessary to provide some source of tokens, whether monetary coins, or non-monetary tokens, in the general vicinity of the games so that the users could buy the tokens to play the games.

In the past, arcades would provide tokens to customers in exchange for some amount of money in various different ways. In some arrangements, a teller or clerk would be present to provide users with tokens, whether monetary coins or non-monetary tokens, in exchange for money from the users. Later, separate mechanized and/or electromechanical change and token dispensing machines were provided within the general vicinity of an arcade, whereby a user would insert money, such as paper bills or metal coins, into the dispenser and in return would receive some set number of tokens for playing the games in the arcade. More recently, with the increased usage of credit or pre-paid cards in lieu of cash, token dispensing machines have been modified to include credit card readers either in addition to or in the alternative from paper and coin cash acceptors. With these systems, a user swipes the card in the card reader and a computer processor within the token dispenser communicates with a local central transaction server, a bank, or other such system or credit clearing organization to ascertain whether the card is authorized for use. If the credit card is so authorized for use, the token dispenser will dispense a certain number of tokens appropriate to some charge that is allocated to the account of the credit card holder. In each of these arrangements, the teller or the token dispenser is generally located in some central area of the arcade but spaced away from the individual game devices such that a user would have to walk away from a game device to obtain tokens from the token dispenser and then return to the game device. The problem with this type of arrangement, however, is that it causes the user to walk away from the game device itself, and during that time the user is not able to play the game, may lose his/her station at the game to another person, and/or may simply lose interest in playing the game. To the owner of the arcade, however, it is preferable to have the game device be played as continually as possible and with as few interruptions in play time as possible in order to maximize the revenue from the arcade.

One way to address some of these concerns is shown in FIG. 1, wherein a token dispenser 10 is located immediately adjacent to a game device 11. The game device 11 requires a token, such as a coin or non-monetary token, to be inserted into a token receiver slot 12 in order to play the game. The token dispenser 10 is carried within a cabinet 13 which can be opened or closed and locked so as to prevent unauthorized access to tokens in the token dispenser 10. A card reader 14, a coin cup 15, and a warning light 16 are located on the exterior of the cabinet 13. To obtain tokens to play the game device 11, a user swipes a credit or pre-paid card in the card reader 14 and, assuming the card is found to be authorized, the token dispenser 10 dispenses a set number of tokens into the coin cup 15 for access by the user. Electronic sensors in or on the token dispenser 10 sense when the token dispenser 10 is out of tokens, and an electronic circuit will cause the warning light 16 to be turned on continually when the token dispenser 10 is empty of tokens. Although effective, there are some drawbacks to this arrangement. First, locating a cabinet 13 adjacent to each game device 11 takes up a significant amount of space that may otherwise be occupied by other game devices. Thus, if the arcade has limited space which is normal, the number of revenue generating game devices 11 that the owner could place in the space would be diminished, and thereby the overall potential revenue generating stream of the arcade could also be negatively impacted due to the fewer number of game devices 11 in the location. Another drawback of this arrangement is that there may be down time or non-use time of the game device 11 if the token dispenser 10 is out of tokens when the user needs to purchase tokens. Because the warning light 16 only activates when the token dispenser 10 is out of tokens, an operator of the arcade has no advance warning to refill the token dispenser 10 prior to the time the token dispenser 10 is empty. While FIG. 1 shows the token dispenser 10 immediately adjacent the game device 11, this is partially for convenience, and in practice, many times the token dispenser 10 is located far removed from the game device 11. As such, a game player must walk across the entire arcade to get tokens. The biggest problem with this arrangement is that players often get distracted when travelling between game device 11 and the token dispenser 10.

In order to overcome some of the drawbacks of the arrangements, some owners of game devices retrofit the game device 11 with a token dispenser 10, card reader 14, coin cup 15, and warning light 16 directly into a cabinet 17 of the game device 11. Although this arrangement can overcome some of the problems with space limitations and distracted gamers, the currently known method of installing the token dispenser 10 and other components into the cabinet 17 is cumbersome and costly because each installation is a custom installation. For example, it is currently known to install the token dispenser to the inside of the cabinet 17 with specially crafted wood braces and support members, which must be custom cut and fit for each different cabinet and game device. Because of the custom nature of the installation, such installation can take a substantial amount of time and therefore can be a relatively costly procedure.

GENERAL DESCRIPTION OF THE DISCLOSURE

According to some aspects of the present disclosure, a mounting bracket suitable for installing a token dispenser to a game device operated by one or more tokens is provided. In one exemplary arrangement, the mounting bracket includes an attachment bracket, a support plate, a support arm, a lock, and a receiver cup. The attachment bracket is for securing to the panel of the game device. The support plate extends away from the flange on the first side of flange to support the token dispenser. The support plate is pivotably connected to the attachment bracket. The attachment bracket includes a web extending from a first side of a flange to be secured to the panel. The support arm is pivotably connected to each of the web and to the support plate to support the support plate from the web. The support arm allows the support plate to be pivoted toward and away from the web. The lock is associated with the support arm. The lock locks the support plate in a selected position pivoted about the attachment bracket. The receiver cup is disposed on a second side of the flange to receive tokens dispensed from a token dispenser. The support plate is pivotably adjustable up or down into a horizontal position. A token can be dispensed into the receiver cup from a token dispenser supported by the support plate.

According to some aspects of the present disclosure, a method of installing the token dispenser to an interior of a game device is provided. In one exemplary arrangement of steps, the flange is secured to an interior side of a panel of the game device with the receiver cup projecting to an exterior side of the panel. The support plate is pivoted about the attachment bracket into a horizontal position. The support plate is locked in the horizontal position with the lock. The token dispenser is secured to the top side of the support plate such that tokens dispensed from the token dispenser travel into the receiver cup.

According to some aspects of the disclosure, a token dispensing system is provided that provides a first warning indication when the level of tokens in the token dispenser is low and a second warning indication when no tokens are in the token dispenser. In one exemplary arrangement, the token dispensing system includes a token dispenser, a first electronic sensor, a second electronic sensor, a warning light, a credit card reader, and an electronic control circuit. The token dispenser has a hopper for receiving tokens and an electronic dispenser to dispense tokens from the hopper. The first electronic sensor is able to sense a first level of tokens in the hopper and provide a token level low signal when the level of tokens in the hopper is below the first level. The second electronic sensor is able to sense when no tokens are in the electronic dispenser and provide a token empty signal when no tokens are in the electronic dispenser. The electronic circuit includes hardware and/or software that is arranged and/or adapted to perform the following steps: receive a token level low signal from the first electronic sensor; send a first warning control signal to cause the warning light to provide a first warning indication in response to the token level low signal; receive a token empty signal from the second electronic sensor; send a second warning control signal to cause the warning light to provide a second warning indication in response to the token empty signal; and cause the token dispenser to dispense a selected number of tokens in response to reading an authorized credit card with the credit card reader.

According to some aspects of the disclosure, a token dispensing system is provided that automatically dispenses any tokens owed to a customer whose token dispensing transaction is interrupted by an empty token dispenser upon refilling the token dispenser and resetting the electronic control circuit. In one exemplary arrangement, the token dispensing system includes a token dispenser having a hopper for receiving tokens and an electronic dispenser to dispense tokens from the hopper, an electronic sensor to sense when no tokens are in the hopper and provide a token empty signal when no tokens are in the hopper, an electronic credit reader, and an electronic control circuit. The electronic control circuit performs the following steps: identifying a selected number of tokens to dispense in response to a credit signal received from the electronic credit reader; disabling the dispenser in response to a token empty signal received from the electronic sensor; re-enabling the dispenser in response to a reset of the electronic control circuit; identifying whether the selected number of tokens was previously dispensed in response to credit signals received immediately prior and subsequent to disabling the dispenser; and causing the dispenser to dispense any remaining tokens necessary to dispense the selected number of tokens if the selected number of tokens was not previously dispensed.

According to some aspects of the present disclosure, a game device is provided. In one exemplary arrangement, the game device includes a housing, a game carried by the housing, and the token dispensing system carried by the housing. The game requires a token for play.

In further accordance with any one or more of the foregoing aspects and exemplary arrangements, a mounting bracket, method, token dispensing system, and/or a game device according to the teachings of the present disclosure may include any one or more of the following optional forms.

In some optional forms, the mounting bracket includes a token slide for directing tokens into the receiver cup. The token slide may be disposed above the support plate and extend from the receiver cup.

In some optional forms, the attachment bracket includes a second web extending from a second flange. An opening is disposed between the first and second flanges. The token slide is disposed between the first and second webs and arranged to guide a token into the receiver cup through the opening.

In some optional forms, one or more elongate adjustment slots are disposed through the support plate arranged to slidably receive a pin extending from a bottom of the token dispenser. The one or more elongate adjustment slots may be axially aligned to allow the token dispenser to be adjusted along the adjustment slot toward and away from the flange.

In some optional forms, the support arm includes a pin guide that slidably receives a pin projecting from the support plate. The lock may include a nut threaded onto the pin and arranged to clamp the support arm against the support plate. The support plate may be disposed below the web and the support arm may be in the form of a hanger tie that extends downwardly from the web to the support plate. A token can be dispensed into the receiver cup through the opening in the attachment bracket from a token dispenser secured to a top side of the support plate In some optional forms, an electronic reader is secured to the game device so as to be accessible from the exterior of the game device. An electronic control circuit may be operatively coupled to the electronic reader and to the token dispenser such that the electronic control circuit causes the token dispenser to dispense a selected number of tokens in response to reading an authorized credit card or monetary unit, such as a coin or bill. A warning light may be secured to the game device so as to be visible from the exterior of the game device. The electronic control circuit may be operatively coupled to the warning light such that the electronic control circuit causes the warning light to provide a first warning signal when a level of tokens in the token dispenser reaches a predefined level and causes the warning light to provide a second warning signal when the token dispenser contains no tokens.

In some optional forms, the electronic control circuit disables the dispenser in response to the token empty signal, re-enables the dispenser in response to a reset caused by refilling the token dispenser with one or more tokens, identifies whether the selected number of tokens was previously dispensed in response to a credit signal received immediately prior to disabling the dispenser, and causes the dispenser to dispense any remaining tokens necessary to dispense the selected number of tokens if the selected number of tokens was not previously dispensed.

In some optional forms, the token dispensing system includes the mounting bracket. The token dispenser may be secured to the top surface of the support plate.

In some optional forms, the game uses the token as a mechanical playing piece or the token is used to start the game. The token may be monetary unit, such as a coin, or a non-monetary unit. The game device may be a mechanical game, such as so-called coin pushers or crane machines, an electromechanical game, such as a pinball machine, and/or an electronic game, such as a video game.

Other viable aspects and optional forms of the a mounting bracket, method, token dispensing system, and/or a game device disclosed herein will be apparent upon consideration of the following detailed description and the appended drawings.

DETAILED DESCRIPTION OF THE DISCLOSURE

Figure 1:
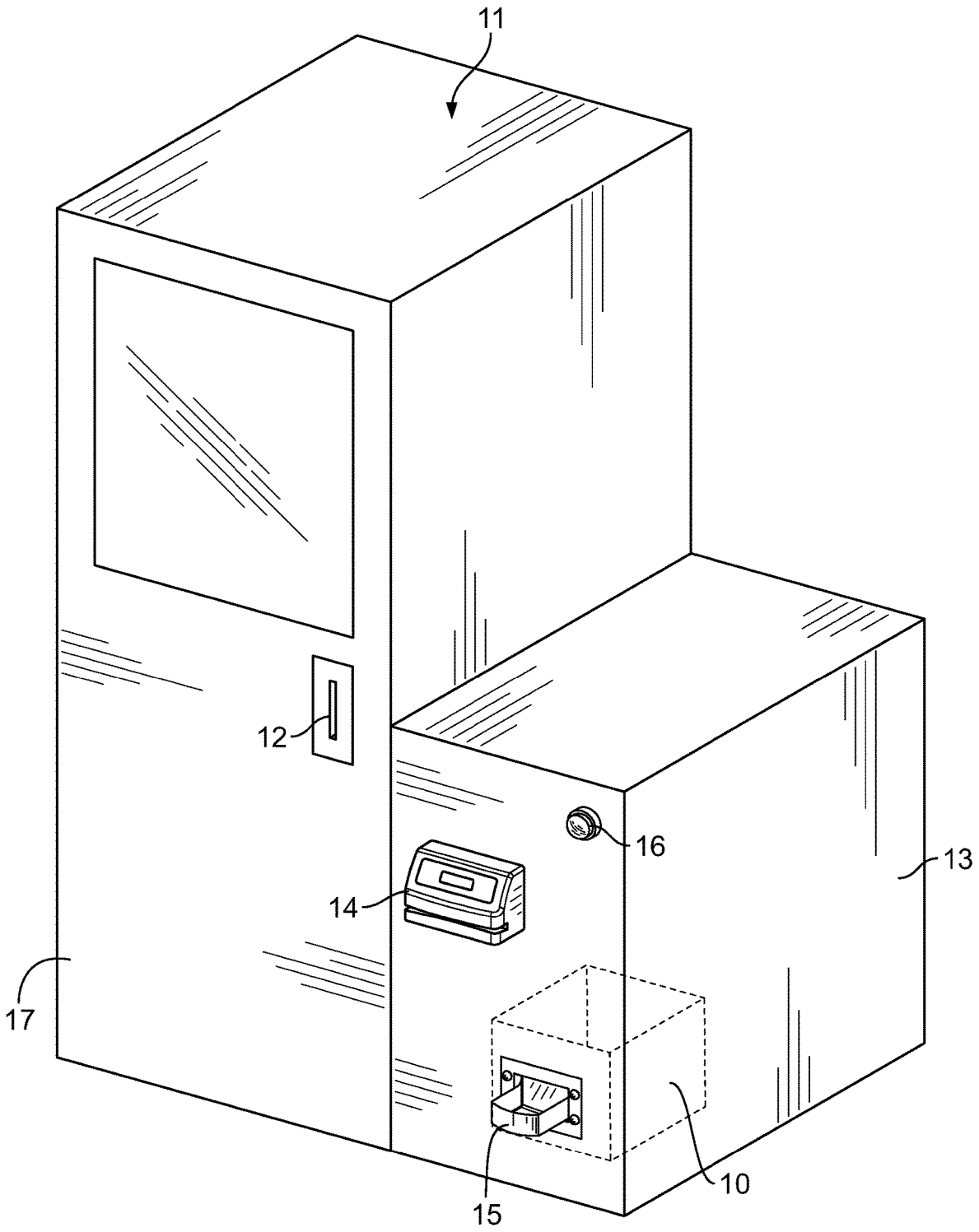
FIG. 1 (Prior Art)
FIG. 1 is an isometric diagrametric view of an exemplary typical token dispenser and game device known in the art.
Figure 2:
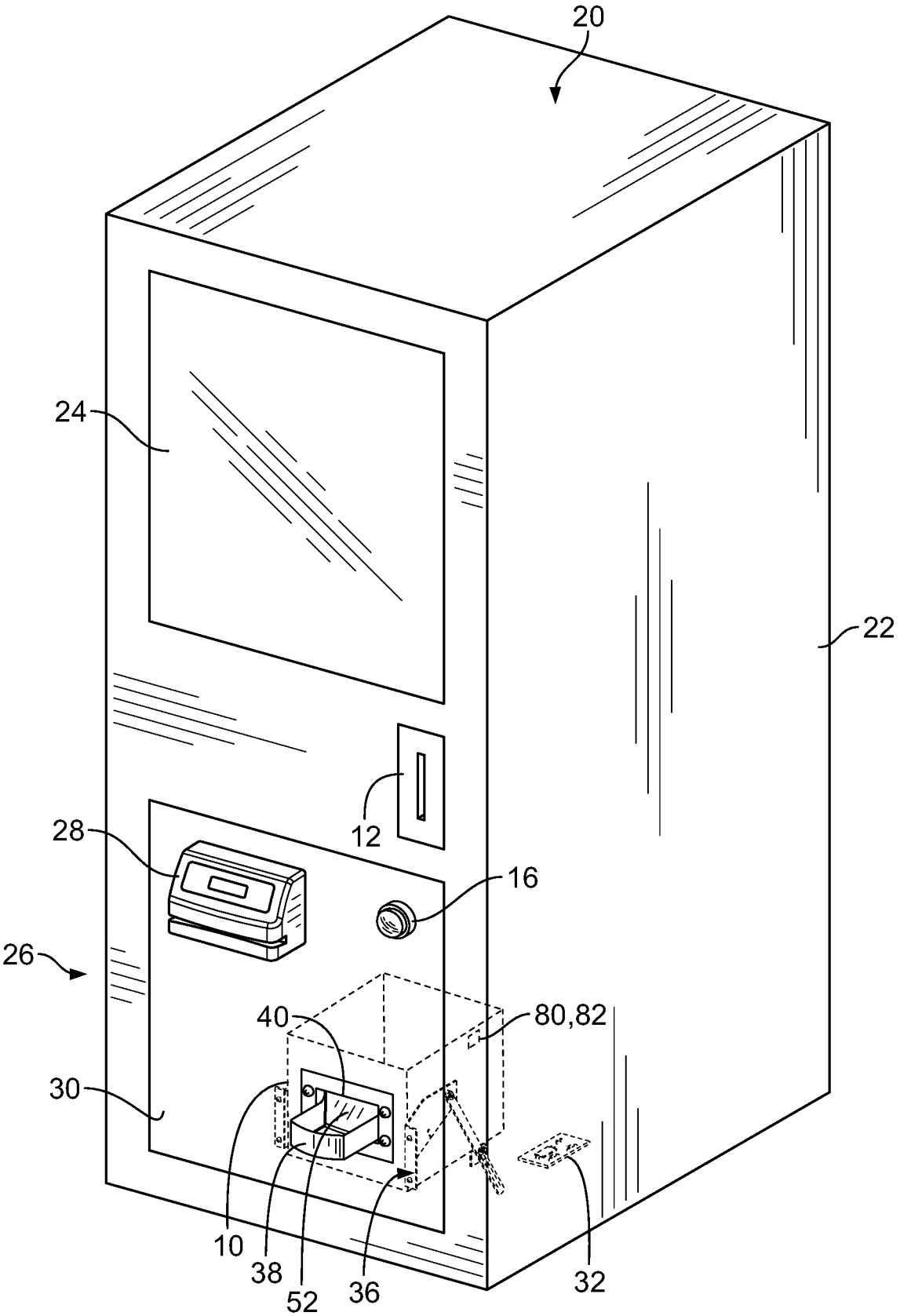
FIG. 2 is an isometric view of a game device with an example token dispensing system installed with installation apparatus according to the teachings of the present disclosure.

Turning now to the drawings, FIG. 2 illustrates a game device 20 including a housing, such as cabinet 22, a game 24 that requires one or more tokens for play and carried by the cabinet 22, and a token dispensing system 26 carried by the cabinet 22 in one exemplary arrangement in accordance with the teachings of the present disclosure. The game 24 may be any type of game that requires a token for play, such as an electronic game, a mechanical game or an electrical mechanical game, as well understood in the art. The game 24 may use a token as a mechanical playing piece, such as money pushers, or the game may require the token only to activate or start play of the game, such as a video game. For example, the token may be a monetary coin or the token may be a non-monetary token, such as a simple disc shaped piece of metal or other type of non-monetary token. The game device 20 may include a token receiver slot 12 for receiving a token to activate and/or play the game 24 in any manner as well understood in the art. The token dispensing system 26 is preferably disposed in an interior portion of the cabinet 22 and secured such that users cannot gain unauthorized access to tokens for playing the game 24 without first providing payment to the token dispensing system 26.

The token dispensing system 26 includes a token dispenser, such as the token dispenser 10, an electronic card reader 28, such as a magnetic strip card reader, an alarm, device such as the warning light 16, installed to a panel 30, such as a door of the cabinet 22, and an electronic control circuit 32. While the present example includes a payment acceptor that is in the form of the electronic card reader 28, other systems of the present disclosure can include a payment acceptor that includes a cash or coin acceptor, an RFID reader for reading RFID chips or tags carried by bracelets or tags, a QR or bar code scanner for scanning QR or bar codes carried by bracelets or tags or even codes displayed on the screen of mobile devices, for example, or generally any other device capable of serving the intended purpose of the payment acceptor. Notwithstanding the foregoing, the electronic card reader 28 of the present example is secured to the panel 30 so as to be accessible to the user on an exterior side of the panel, for example, to swipe a card. The warning light 16 is mounted to the panel 30 so as to be visible to the or on the exterior of the cabinet 16. The warning light 16 may be any lighted visual indicator capable of displaying at least three distinct light indications, for example, an off indication, a blinking indication, and a steady on indication. The warning light 16, for example, may include a video screen or LED screen, an incandescent or LED light bulb, or other light mechanism. Still further, instead of the warning light 16, the alarm device can include an audible alarm device or some other type of alarm system. For example, an audible alarm device might include a speaker for emitting a ringtone or other alarm sound to alert personnel. Still other types of alarm devices can include SMS texting systems, emailing systems, or pager type systems, for example, where the alarm device automatically sends an SMS text, email, page, or other message to operating personnel when activated. In yet another form, the alarm device can include one or more of the visual, audible, and messaging systems, and/or any other type of system capable of serving the intended purpose.

Figure 3:
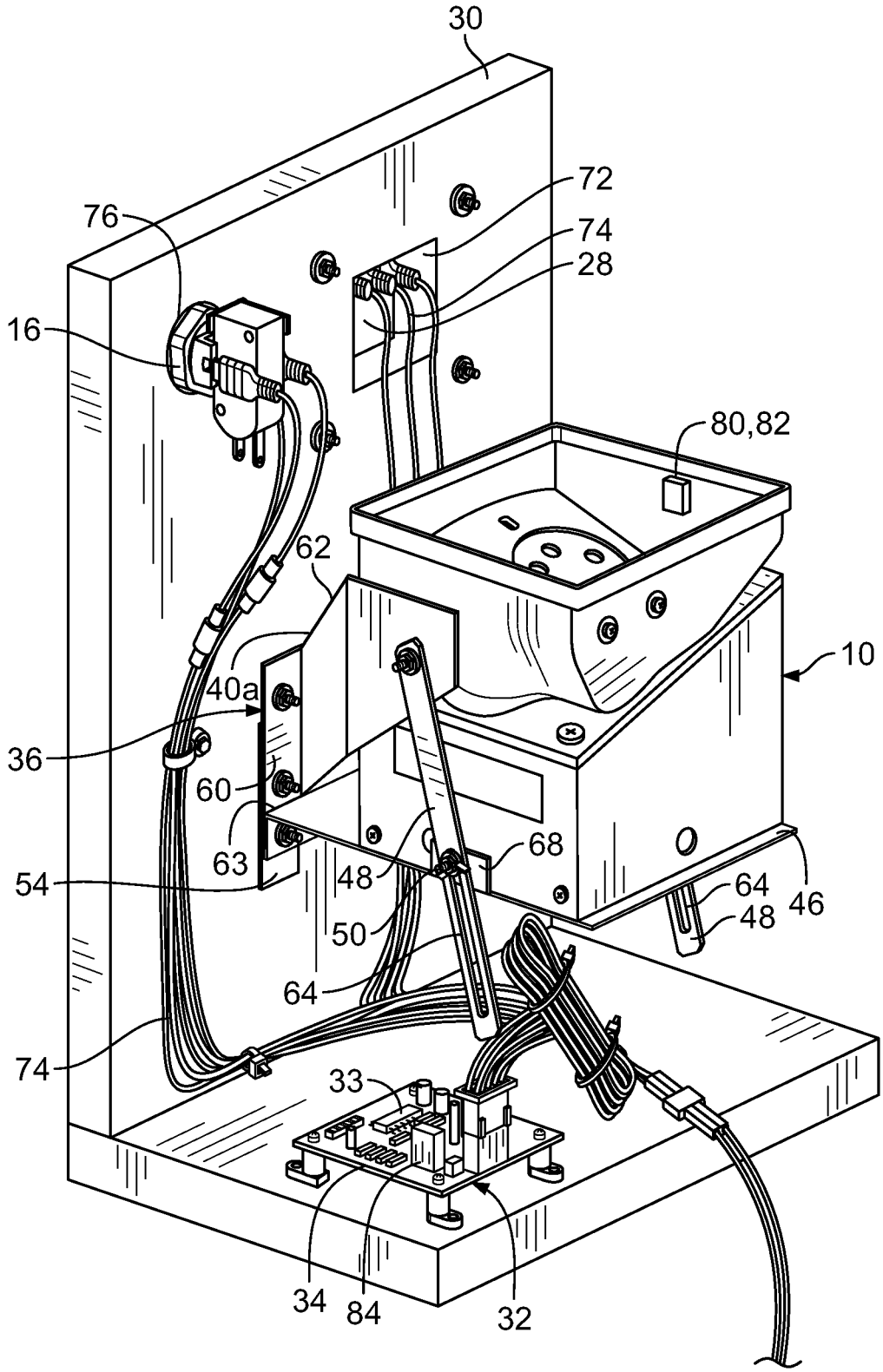
FIG. 3 is an enlarged isometric view of the token dispensing system of FIG. 2 installed with a mounting bracket to an interior panel or door of the game device.

The electronic control circuit 32 may be any combination of electrical and electronic computing and circuit devices, including for example a digital computer processor 33 disposed on a control circuit board 34, as illustrated in FIG. 3, that is arranged to control operation of the token dispenser 10 and/or the token dispensing system 26. The electronic control circuit may include software and/or hardware, electronic memory, and other control circuit components readily understood in the art arranged to form one or more electrical circuits to cause the token dispenser 10 to dispense a selected number of tokens in response to receiving a payment signal from the electronic card reader 28 and/or to control the warning light 16 in a manner described in further detail hereinafter.

The token dispensing system 26 preferably includes a mounting bracket 36 for mounting the token dispenser 10 to the panel 30 as described in further detail hereinafter. The mounting bracket 36 is mounted to the interior side of the panel 30 and includes a receiver cup 38 that preferably extends through a hole 40 in the panel 30 such that tokens dispensed from the token dispenser 10 inside of the cabinet 22 are accessible in the receiver cup 38 to a user on the outside of the cabinet 22.

Figure 4:
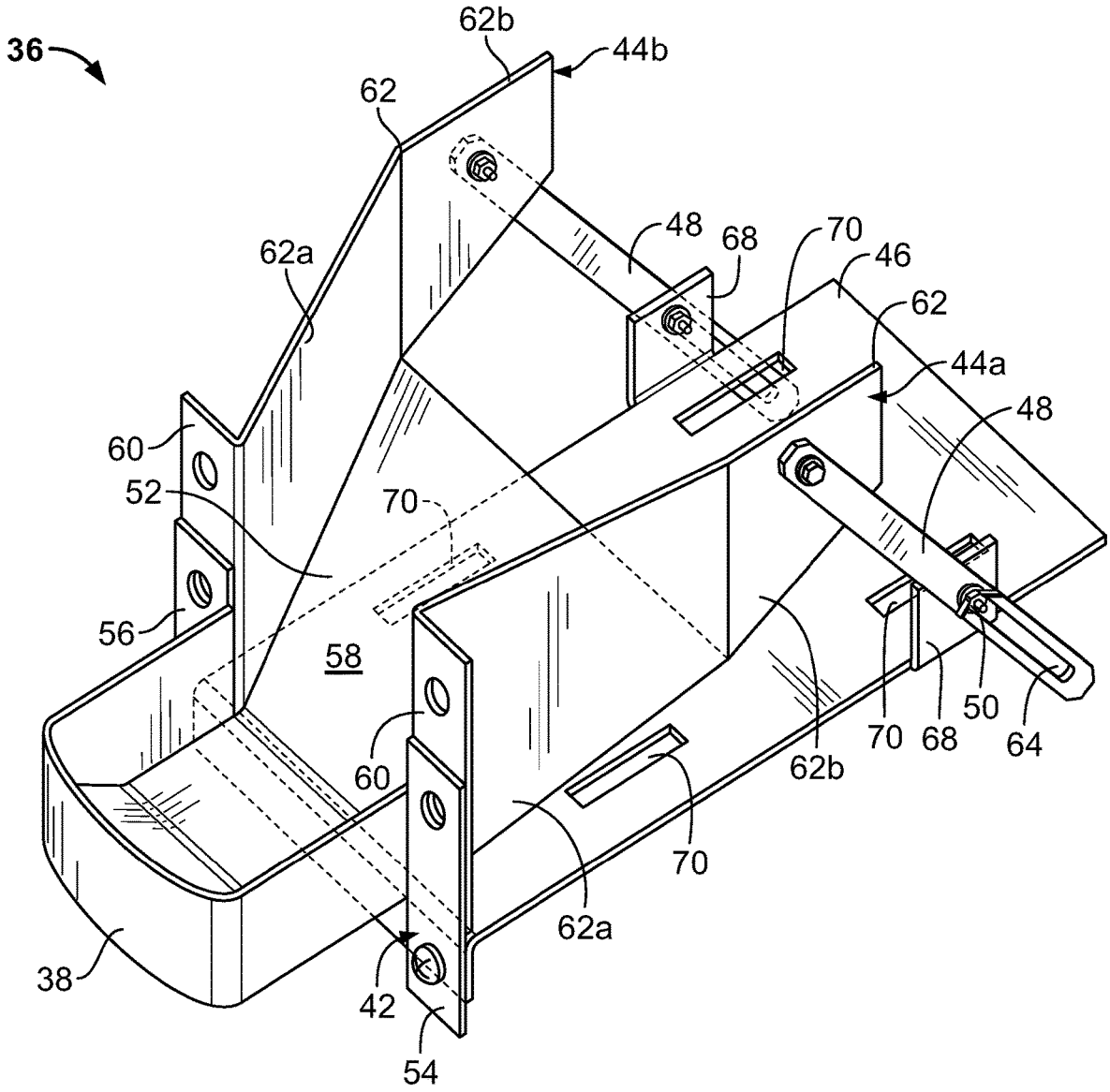
FIG. 4 is an isometric view of the mounting bracket of FIG. 3 shown in isolation.

With reference to FIGS. 3 and 4, a detailed exemplary arrangement of the mounting bracket 36 according to the teachings of the present disclosure is shown in further detail. The mounting bracket 36 includes an attachment bracket 42 for mounting to the panel 30, for example, with screws, bolts, or other fasteners, at least one and preferably two wing walls 44*a* and 44*b* extending from a first side of the attachment bracket 42, a support plate 46, a support arm 48 extending from each wing wall 44*a*, 44*b* to the support plate 46, a lock 50 associated with one and preferably both of the support arms 44, the receiver cup 38 extending from a second side of the attachment bracket 42, and a token slide 52 extending from the receiver cup 38.

The attachment bracket 42 includes a first flange 54 disposed on a first side of the receiver cup 38 and a second flange 56 disposed on an opposite side of the receiver cup 38. Each of the first and second flanges 54, 56 is formed for example as a flat bar or elongate plate. The first and second flanges 54 and 56 are preferably disposed in a common single plane, for example, suitable for attachment to a flat side surface of the panel 30. The first flange 54 is spaced apart from the second flange 56 to define a mouth, such as an opening 58, therebetween. Optionally, the first flange 54, the second flange 54, and the receiver cup 38 are formed as a single unitary piece defining the attachment bracket 42.

The wing walls 44*a* and 44*b* are substantially mirror images of each other disposed on opposite sides of the opening 58 and the token slide 52. Each wing wall 44*a*, 44*b* includes a flange 60 and a web 62. The wing walls 44*a* and 44*b* and the token slide 52 preferably are formed as a unitary piece arranged for attachment to the first side of the attachment bracket 42 such that the token slide 52 connects or engages with or directs tokens into the receiver cup 38 at or near the opening 58. The flange 60 of the wing wall 44*a* is secured to the first flange 54, and the flange 60 of the wing wall 44*b* is secured to the second flange 54, for example with screws, bolts, welds or other fasteners. The web 62 extends away from the flange 60 at an angle, such as between approximately 45 degrees and 135 degrees, so as to project away from the flange 60 on the first side of the attachment bracket 42. Each web 62 includes a first portion 62*a* that extends from the flange 60 at an acute angle, for example between about 65 degrees and about 85 degrees, and a second portion 62*b* that is angled with respect to the first portion 62*a* and substantially perpendicular to the flange 60. The opposing second portions 62*b* of the wing walls 44*a*, 44*b* are substantially parallel and spaced apart from each other a width arranged to receive the token dispenser 10 therebetween. The opposing first portions 62*a* of the wing walls 44*a* and 44*b* taper or funnel inwardly from the second portions 62*b* toward the opening 58.

The token slide 52 extends between opposite lower edges of the webs 60 along the first portion 62*a* from a back edge near or at the second portion 62*b* to a front edge adjacent the receiver cup 38. The bottom edges of the first portions 62*a* of the wing walls 44*a* and 44*b* are connected to opposite edges of the token slide 52. The token slide 52 extends upwardly and away from the receiver cup 38 on the first side of the attachment bracket. The token slide 52 is aligned with the opening 58 such that tokens sliding down the token slide 52 can pass through the opening 58 into the receiver cup 38.

The support plate 46 has a first end connected to the first side of the attachment bracket 42 at the first and second flanges 54 and 56 extends away from the flanges 54 and 56 to a second end disposed away from the attachment bracket 42. The support plate 46 is pivotably coupled to the attachment bracket 42, for example along a hinge 63, such as a crease, living hinge, or fold, near the first end of the support plate about which the support plate is more easily pivoted than at other locations. Optionally, the support plate 46 may include a hinge 63, such as a pin and barrel hinge or other type of hinge that facilitates rotating the support plate 46 relative to the attachment bracket 42. The second end of the support plate 46 can be pivotably adjusted around the hinge 63 so as to, for example, adjust the second end of the support plate 46 up and/or down into a horizontal position for supporting the token dispenser 10 in a generally verified orientation on a top side thereof. This is particularly useful when the panel 30 of the cabinet 22, for example, is not vertically oriented. The support plate 46 is preferably formed of a separate item, such as a metal plate or sheet with a bent end flange adjacent the hinge 63 and that is secured to the flanges 52, 54 with appropriate fasteners or may be formed integrally with the attachment bracket 42.

The support arm 48 is in the form of a hanger tie having a first end pivotably connected to the web 62 of the wing wall 44*a* or 44*b*, for example by a bolt, pin, or screw, and a second end that is pivotably connected to the support plate 46, for example by another bolt, screw, or pin. Each support arm 48 further includes a pin guide 64 that slidably receives a pin 66 projecting associated with the support plate 46. The pin 66 is preferably carried by an upstanding tab 68 along the edge of the support plate 46. The pin guide 64 is in the form of an elongate slot along the axis of the support arm 44 on the second end of the support arm that receives the pin 66 therein.

The lock 50 may be any mechanism suitable for locking the support plate 46, the support arms 44, and the wing walls 44*a*, 44*b* in a selected rotational position relative to each other. For example, the lock 50 is in the form of a wing nut screwed onto the end of the pin 66 so as to allow the wing nut to clamp the support arm 48 into a selected position along the slot of the pin guide 64 against the tab 68. Thus, to adjust the support plate 46 into a horizontal position, the support plate 46 is pivoted around the hinge 62 until in a horizontal position. Simultaneously, the pin 66 slides axially along the support arm 48, up and/or down along the pin guide 64. The wing nut is tightened down to clamp the support arm 48 into the selected position against the tab 68. The mounting bracket 36 preferably includes a support arm 48 extending from each of the opposing webs 62 and connecting to a tab 68 on each opposite side of the support plate 46 with a lock 50 associated with the support arm as shown in FIG. 4.

At least one or more, preferably four, elongate adjustment slots 70 are disposed through the support plate 46. The elongate adjustment slots 70 are arranged to slidably receive a pin or extension extending from the bottom of the token dispenser 10. The elongate adjustment slots 70 are aligned axially perpendicular to the flanges 52 and 54 so that token dispenser 10 may be shifted toward and/or away from the attachment bracket 42, thereby ensuring the token dispenser 10 properly dispenses tokens onto the token slide 52. Further, the token dispenser 10 may be clamped onto the support plate 46 with for example nuts threaded onto bolts extending through the elongate adjustment slots 70.

In the depicted arrangement, the support plate 46 is disposed below the webs 62 of the wing walls 44*a*, 44*b* such that the support arms 48 are in the form of hanger ties that extend downwardly from each web 62 to the support plate 46. In other arrangements, the support plate 46 may be disposed above the wing walls 44*a*, 44*b* such that the support arms 48 form struts extending upwardly from the webs 62 of the wing walls to the support plate 46. In such an alternative arrangement, the token slide 52 may be formed separately from the wing walls.

The mounting bracket 36 provides a convenient and easy way to install the token dispenser 10 to a panel 30, such as to an interior side of a door or other panel of the game device 12. In one exemplary method according to the teachings of the present disclosure, the hole 40 for receiving the receiver cup 38 is cut through the panel 30. Then, the first and second flanges 54 and 56 of the mounting bracket 36 are secured to the interior side of the panel 30 with the receiver cup 38 projecting through the hole 40 and to an exterior side of the panel 30. The flanges 54, 56 may be secured to the panel 30 for example with screws, bolts or other fasteners. The support plate 46 is pivoted about the attachment bracket 42 into a horizontal position, such as by rotating the second end of the support plate about the hinge 63 after the flanges 52 and 54 have been secured to the interior side of the panel 30. It is noted that the term horizontal is used herein to mean that the support plate 46 is sufficiently horizontal to support the token dispenser 10 in a generally vertical orientation on a top surface thereof, it being understood that the support plate 46 may not be exactly horizontal in a mathematical or geological sense but rather may be out of mathematical or geological horizontal by some small amount, which may be tolerable to not interfere with the operation of the token dispenser 10. After the support plate 46 is in a selected horizontal position, the support plate 46 is locked into the horizontal position with the lock 50, for example by tightening the wing nuts sufficiently to clamp the support arms 44 to the tabs 68. The token dispenser 10 is secured to the top side of the support plate 46 such that tokens dispensed from the token dispenser 10 will fall into the receiver cup 38. For example, the token dispenser 10 may be shifted toward or away from the attachment bracket 42 along the elongate adjustment slots 70 and secured in a position such that a token dispensed from a token dispenser will fall onto the token slide 52 and slide down the token slide 52 into the receiver cup 38 through the opening 58. Although the steps of securing the token dispenser to the game device 12 may be performed in any order, it is preferred to secure the mounting bracket 36 to the panel 30, then to adjust the support plate 46 into its horizontal position, then to lock the support plate 46 in the horizontal position with the lock 50, and then secure the token dispenser 10 to the top side of the support plate 46 after it has been locked in the horizontal position.

Either before or after the token dispenser 10 is installed to the panel 30 with the mounting bracket 36, the electronic card reader 28 is preferably secured so as to be accessible from the exterior of the game device 12, such as to an exterior side of the panel 30. Preferably, the electronic card reader 28 is secured to the exterior of the panel 30 covering an opening 72 through the panel 30 through which wires 74 of a control harness extend from a back end of the electronic card reader 28 into the interior of the cabinet 22. The warning light 16 is also mounted to the panel 30 such that the light is visible to the exterior, such as through an opening 76 through the panel 30. Each of the electronic card reader 28 and the warning light 16 is operatively coupled to the electronic control circuit 32, for example, by the wires 74 operatively connected to the digital computer processor 33 on the control circuit board 34.

The electronic card reader 28 is operatively coupled to the electronic control circuit 32 such that the electronic control circuit 32 causes the token dispenser 10 to dispense a selected number of tokens in response to a payment signal received from the electronic circuit reader. Preferably, the electronic control circuit 32 is able to communicate via a communication link, such as a wired or wireless telecommunication link, with a bank or credit clearing house organization or other transaction server to identify whether a card, for example, is authorized for a particular charge and then to send any charge to the account of the card to the bank or credit clearing house or other transaction server in order to receive payment therefrom in a manner well understood in the art.

The warning light 16 is operatively coupled to the electronic control circuit so as to cause the warning light 16 to provide a first warning signal, such as a steady or continually on light, when the level of tokens in the token dispenser reaches a predefined low level as sensed by a first electronic sensor 80 carried by the token dispenser 10. The warning light 16 is operatively coupled to the electronic control circuit so as to cause the warning light 16 to provide a second warning signal, such as a flashing light, when the token dispenser 10 contains no tokens, or is empty. The warning light is operatively coupled to the electronic control circuit 32 so as to cause the warning light 16 to provide a third signal, such as an off light, when the level of tokens in the token dispenser 16 is above the predefined low level.

Figure 5:
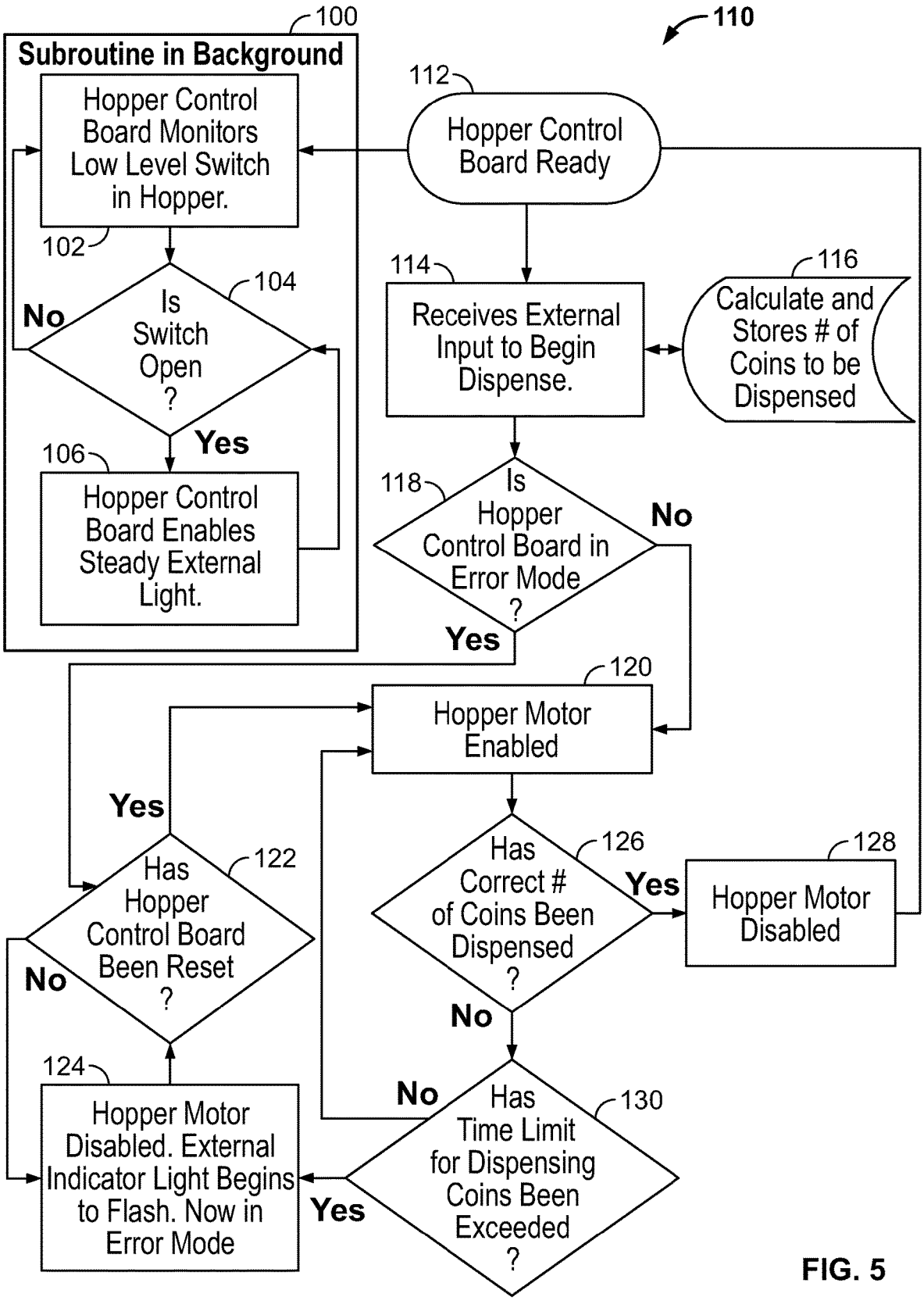
FIG. 5 is a logic flow chart diagram of a control routine implemented by an electronic control circuit of the token dispensing system of FIG. 3.

Turning now to FIG. 5, the electronic control circuit 32 including the digital computer processor 33 and/or the control circuit board 34 is arranged, for example, by appropriate software coding and/or hardwire circuitry, to control operation of the token dispenser 10 for dispensing tokens, operating the electronic card reader 28, and operating the warning light 16 in the manners described herein. Thus, in one exemplary arrangement, the electronic control circuit is arranged to receive a token level low signal from the electronic sensor 80 when the level of tokens in the token dispenser has reached or fallen below the predefined low level to be sensed by the electronic sensor 80. In response to receiving the token level low signal, the electronic control circuit sends a first warning control signal to the warning light 16, which causes the warning light 16 to provide the first warning indication, such as by blinking on and off. The electronic control circuit also receives a token empty signal from a second electronic sensor 82, which is arranged to sense when there are no tokens left in the token dispenser 10 for dispensing to a user. As shown in FIG. 3, it is possible that the first and second sensors 80, 82 are the same sensor, or they can be different sensors. In response to receiving the token empty signal, the electronic control circuit sends a second warning control signal to the warning light 16, which causes the warning light 16 to provide the second warning indication, such as a continuously on light.

The electronic control circuit 32 is also arranged to cause the token dispenser 10 to dispense an appropriate selected number of tokens in response to receiving a payment signal from the electronic card reader 28. For example, if the electronic card reader 28 is a magnetic strip card reader, the electronic control circuit 32 will receive account information from the card reader, will send the account information to a credit clearing organization, such as a bank or other organization or other transaction server, to identify whether the card is authorized to purchase tokens. If the card is indicated as being authorized to make a charge, the electronic control circuit sends a charge to the account of the card, and causes the token dispenser 10 to dispense an appropriate number of tokens based on the amount authorized to be charged to the account. The electronic control circuit and the electronic card reader 28 may perform the financial transactions necessary for reading the card and charging the card in any way suitable and well understood in the art.

FIG. 5 illustrates a logic flow diagram of one exemplary set of control steps implemented by the electronic control circuit 32 in a control program for controlling the warning light 16 and dispensing of tokens from the token dispenser 10. The control program may be implemented by software and/or hardware in a manner well understood in the programming arts. The control program includes a subroutine 100 and a main routine 110. The main routine controls dispensing the correct number of tokens from the token dispenser 10 and monitors whether the token dispenser 10 is completely empty of tokens. The subroutine 100 runs in the background, preferably repeatedly and/or continually when the main routine 110 is not running, to monitor whether the level of tokens in the hopper of the token dispenser 10 is at or below the predefined low level.

In the sub routine 100, the electronic control circuit 32 monitors the electronic sensor 80 in the hopper of the token dispenser 10 at a block 102. A block 104 queries whether the electronic sensor 80 is open. If the electronic sensor 80 is not open, then control returns to block 102. If the electronic sensor 80 is open, then a block 106 transmits the first warning control signal to the warning light 16 to provide the first warning indication, preferably a steady external light. Control then passes back to block 104. The subroutine continues to be repeated as long as the electronic control circuit 32 does not receive an external input for dispensing one or more tokens from the token dispenser 10.

In the main routine 110, the electronic control circuit 32 causes the token dispenser 10 to dispense tokens in response to receiving an authorized payment signal, identifies when the token dispenser is out of tokens, provides the second warning signal to the light 16 when the token dispenser is out of tokens, and ensures that a user receives the correct number of tokens that were paid for in the transaction initiated immediately prior to the token dispenser 10 running out of tokens. At a block 112, the electronic control circuit is set in a ready condition. At a block 114 the electronic control circuit 32 receives external input in the form of an authorized payment transaction, such as from the bank or credit clearing house in response to an account query from a user swiping a card in the electronic card reader 28 as described previously, to begin dispensing tokens. A block 116 calculates and stores, such as in a digital electronic memory storage device, (e.g., ROM, RAM, etc.), the selected number of tokens to be dispensed in response to the amount of the authorized credit and provides the selected number of tokens to the block 114. A block 118 queries whether the electronic control circuit 32 is in error mode. If the electronic control circuit 32 is not in error mode, then control passes to a block 120 where the hopper motor of the token dispenser 10 is activated. If the electronic control circuit 32 is in error mode, a block 122 queries whether the electronic control circuit 32 has been reset. If the electronic control circuit has been reset, control passes to the block 120 to activate the hopper motor. If the electronic control circuit 32 has not been reset, control passes to a block 124, which disables the hopper motor and causes the second warning control signal to be provided to the warning light 16 to provide the second warning indication, such as causing the warning light 16 to repeatedly flash on and off. Control passes from block 124 back to block 122 and repeats the loop until such time as the electronic control circuit has been reset and thereafter control passes the block 122 to block 120 to activate the hopper motor. After the hopper motor is enabled, a block 126 queries whether the correct number of coins, i.e., equal to the selected number of coins stored in the block 116, has been dispensed. If the correct number of coins has been dispensed, then a block 128 disables i.e. turns off, the motor of the token dispenser and control returns to block 112. If the correct number of coins matching the selected number of coins stored in block 116 has not been dispensed, a block 130 queries whether a predefined time limit for dispensing the coins has been exceeded. If the predefined time limit has been exceeded, control passes to block 124 to disable the hopper motor and activate the warning light 16 in the second warning signal. If the predefined time limit for dispensing coins has not been exceeded, control returns to block 120 to again enable i.e. turn on, the hopper motor of the token dispenser 10. In this manner, even if the token dispenser 10 runs out of tokens in the middle of dispensing the selected number of tokens purchased at a transaction by a user, an attendant can refill the hopper of the token dispenser 10 and reset the electronic control circuit 32, which will cause the token dispenser 10 to continue dispensing tokens until the selected number of tokens purchased is dispensed.

A primary resent button 84 is preferably located on the control circuit board 34 for manually resetting the electronic control circuit 32, for example, when an operator re-fills the hopper of the token dispenser 10. Activating the primary reset button 84 resets the electronic control circuit 32 as described in relation to FIG. 5. The wiring harness (e.g., wires 74) allows an optional remote reset switch (not shown) to be operatively connected to the control circuit board 34 and/or the electronic control circuit 32 when needed.

In view of the foregoing, it can be seen that the devices and methods of the present disclosure possess the following industrial applicability. That is, token dispensing systems, mounting brackets, methods, and game devices according the teachings of the present disclosure are useful for installing token dispensers to game devices, ensuring accurate completion of token dispensing when interrupted by an empty token dispenser, and/or providing early warning to an operator of a low level of tokens in a token dispenser, for example, as described in the technical example provided herein. However, the other or alternative uses, benefits, and/or arrangements of the various components of the disclosure are also possible, and the invention is not to be limited to the examples described in detail herein.

The technical examples described and shown in detail herein are only exemplary of one or more aspects of the teachings of the present disclosure for the purpose of teaching a person of ordinary skill to make and use the invention or inventions recited in the appended claims. Additional aspects, arrangements, and forms of the invention or inventions within the scope of the appended claims are contemplated, the rights to which are expressly reserved.

What is claimed:

1. A mounting bracket adapted to install a token dispenser to an interior of a panel of a game device, the mounting bracket comprising:

an attachment bracket for securing to the panel of the game device;

a support plate extending transversely away from the attachment bracket on a first side of the attachment bracket to support the token dispenser, the support plate is connected to the attachment bracket in a manner that allows pivotable adjustment of the support plate relative to the attachment bracket;

a lock associated with the mounting bracket that locks the support plate in a selected position pivoted about the mounting bracket; and a receiver cup on a second side of the attachment bracket to receive tokens dispensed from the token dispenser, wherein the support plate is pivotably adjustable up or down into a horizontal position, and wherein a token can be dispensed into the receiver cup from the token dispenser supported by the support plate.

2. The mounting bracket of claim 1, further comprising a web coupled to the attachment bracket, the lock disposed between the web and the support plate.

3. The mounting bracket of claim 2, further comprising a support arm connected between the web and the support plate, the lock is associated with the support arm.

4. The mounting bracket of claim 3, wherein the lock comprises a pin and a nut and the support arm comprises a pin guide, the pin extending through the pin guide and the nut threadably engaging the pin.

5. The mounting bracket of claim 4, further comprising a tab extending from the support plate and comprising an aperture, the pin extending through the aperture.

6. The mounting bracket of claim 1, wherein the attachment bracket comprises a first flange and a second flange, an opening defined between the first flange and the second flange, the receiver cup disposed between the first and second flanges.

7. The mounting bracket of claim 6, further comprising a first wing wall and a second wing wall disposed on opposite sides of the opening, the first wing wall coupled to and extending from the first flange and the second wing wall coupled to and extending from the second flange.

8. The mounting bracket of claim 7, wherein the first wing wall, the second wing wall, and the receiver cup comprise a unitary piece.

9. The mounting bracket of claim 7, wherein the first and second wing walls have distal portions, the first and second wing walls taper inwardly from the distal portions toward the opening.

10. The mounting bracket of claim 7, further comprising a token slide aligned with the opening and extending upwardly away from the receiver cup.

11. The mounting bracket of claim 1, further comprising a hinge, the hinge coupling the support plate and the attachment bracket, the hinge allowing the pivotable adjustment of the support plate relative to the attachment bracket.

12. The mounting bracket of claim 11, wherein the hinge comprises a living hinge.

13. The mounting bracket of claim 1, further comprising webs coupled to the attachment bracket, support arms coupled between the webs and the support bracket, the lock carried by one of the support arms.

14. A token dispensing system adapted to install to an interior of a panel of a game device, the system comprising:

an attachment bracket for securing to the panel of the game device;

a token dispenser on a first side of the attachment bracket and connected to the attachment bracket in a manner that allows pivotable adjustment of the token dispenser relative to the attachment bracket;

a lock associated with the attachment bracket that locks the token dispenser in a selected position pivoted about the attachment bracket; and a receiver cup on a second side of the attachment bracket to receive tokens dispensed from the token dispenser, wherein the token dispenser is pivotably adjustable up or down into a horizontal position, and wherein a token can be dispensed into the receiver cup from the token dispenser.

15. The token dispensing system of claim 14, further comprising a support plate extending transversely away from the attachment bracket on the first side of the attachment bracket to support the token dispenser.

16. The token dispensing system of claim 15, wherein the support plate is connected to the attachment bracket in a manner that allows pivotable adjustment of the support plate relative to the attachment bracket.

17. The token dispensing system of claim 15, further comprising a web attachable to the panel of the game device, the lock disposed between the web and the support plate.

18. The token dispensing system of claim 17, further comprising a support arm connected between the web and the support plate, the lock is associated with the support arm.

19. The token dispensing system of claim 18, wherein the lock comprises a pin and a nut and the support arm comprises a pin guide, the pin extending through the pin guide and the nut threadably engaging the pin.

20. A method of installing a token dispensing system to an interior of a panel of a game device having a hole, the method comprising:

securing an attachment bracket to the panel of the game device, a support plate extending transversely away from the attachment bracket on a first side of the attachment bracket, the support plate being connected to the attachment bracket in a manner that allows pivotable adjustment of the support plate relative to the attachment bracket;

positioning a receiver cup through the hole on a second side of the attachment bracket;

disposing a token dispenser on the support plate to support the token dispenser, the receiver cup adapted to receive tokens dispensed from the token dispenser; and securing a lock associated with the attachment bracket to lock the token dispenser in a selected position pivoted about the attachment bracket.

21. The method of claim 20, further comprising unsecuring the lock, pivotably adjusting the selected position of the token dispenser up or down into a horizontal position, and resecuring the lock.

* * * * *